United States Patent [19]

Miller

[11] Patent Number: 4,614,500

[45] Date of Patent: Sep. 30, 1986

[54] FLOTATION PLATFORM

[75] Inventor: David D. Miller, Brick, N.J.

[73] Assignee: The Garrett Corporation, Los Angeles, Calif.

[21] Appl. No.: 762,013

[22] Filed: Jul. 31, 1985

Related U.S. Application Data

[63] Continuation of Ser. No. 529,919, Sep. 7, 1983, abandoned.

[51] Int. Cl.[4] ..... B63H 11/107

[52] U.S. Cl. ..... 441/40; 114/345

[58] Field of Search ..... 441/35, 54, 82, 83, 441/86, 87, 38, 39, 40; 114/345, 346, 348-350, 311, 122, 362

[56] References Cited

U.S. PATENT DOCUMENTS

| | | | |
|---|---|---|---|
| 1,392,533 | 10/1921 | Smyth | 114/345 |
| 1,508,881 | 9/1924 | Hodgson | 441/35 |
| 2,421,679 | 6/1947 | Bingham | 114/345 |
| 2,933,739 | 4/1960 | Miller et al. | 441/40 |
| 3,037,218 | 6/1962 | Brooks | 441/38 |
| 3,736,607 | 6/1973 | Radnofsky et al. | 441/37 |
| 3,768,761 | 10/1973 | Cramer | 114/348 |
| 3,843,983 | 10/1974 | Tangen | 441/38 |
| 3,883,913 | 5/1975 | Givens | 441/38 |
| 4,001,905 | 1/1977 | Givens | 441/38 |
| 4,083,070 | 4/1978 | Martin | 441/40 |
| 4,187,570 | 2/1980 | De Simone | 441/37 |
| 4,216,559 | 8/1980 | Switlik | 441/40 |

FOREIGN PATENT DOCUMENTS

| | | | |
|---|---|---|---|
| 220487 | 2/1959 | Australia . | |
| 1226037 | 5/1959 | France . | |
| 1559979 | 3/1968 | France . | |
| 522126 | 3/1955 | Italy . | |
| 368096 | 3/1932 | United Kingdom | 441/40 |
| 1172267 | 11/1969 | United Kingdom | 441/40 |

*Primary Examiner*—Trygve M. Blix
*Assistant Examiner*—Jesûs D. Sotelo
*Attorney, Agent, or Firm*—Terry L. Miller; Albert J. Miller

[57] ABSTRACT

Bifacial inflatable life raft structure defining a plurality of boarding stations equally useable by evacuees irrespective of facial orientation of the structure upon a body of water. Sea ballast structure with such a life raft is also disclosed.

7 Claims, 4 Drawing Figures

FLOTATION PLATFORM

This is a continuation of application Ser. No. 529,919 filed Sept. 7, 1983 now abandoned.

BACKGROUND OF THE INVENTION

The field of this invention is flotation platforms, particularly of the inflatable variety, and method of making and using such flotation platforms. With still more particularity, the invention relates to a bifacial specie of inflatable life raft presenting a multitude of boarding stations by which an evacuee may enter the raft unassisted, and which also provide purchase for able-bodied evacuees aboard the platform to assist an injured or otherwise disabled person to board the raft.

Conventional inflatable life rafts are known which are bifacial. That is, the life raft when inflated and upon the surface of the sea presents substantially the same utility and serviceability with either side up. Further, a conventional bifacial life raft is known which presents a pair of boarding stations whereat evacuees may conveniently leave the sea and board the raft. For example, a life raft of such character is known according to U.S. Pat. No. 2,933,739, issued Apr. 26, 1960 to R. L. Miller, et al., wherein the life raft is composed essentially of a stacked pair of open-centered inflatable ellipses sandwiching a panel of fabric therebetween. The fabric panel defines a floor for the raft. The ellipses are rotated relative to one another and secured together so that the major axes of the ellipses are disposed perpendicularly to one another. The raft thus defines four boarding stations; a pair of which are useable with one face of the raft upward, and another separate pair of which are useable with the other reverse face of the raft upward. An inflatable step is provided at each boarding station.

Life raft constructed according to the teaching of Miller, et al., are believed to have many deficiencies. For example, the raft has only a pair of boarding stations which are usable at any one time. This feature of the Miller, et al., raft limits the rate at which the potential occupants may leave the sea and board the raft. After a ship wreck or airplane crash, there may be a multitude of persons in the sea, many of which may be injured and of short endurance. A delay in boarding an available life raft may mean death for injured or weakened persons who simply cannot struggle for life or tread water long enough while waiting for help or for their turn to board the raft. In the confusion and fear surrounding such tragedies, weakened or injured persons may simply slip beneath the waves and their loss go unnoticed at the time.

Further, a life raft according to the Miller, et al., teaching is believed to be comparatively bulky and heavy with a plurality of seams. Such is the case because the ellipses of the raft body are in fact defined by plurality of relatively short, straight tubular sections which are jointed to one another. Thus, each of the straight tubular sections must define a seam with each of its neighboring adjacent tubular sections. Such a multitude of seams adds both weight and bulkiness to the raft, and each seam presents the risk of a leak in the raft. The bulk and weight of a raft according to Miller, et al's teaching is increased still further by the inflatable step section provided at each of the four boarding stations. These step sections are four in number, although only two of the steps may be utilized at a time dependent upon which side of the raft is upward. Thus, the other two unused step sections are truly superflous bulk even though they are necessary with the life raft of Miller, et al.

Yet another shortcoming of the Miller, et al., life raft is believed to be its considerable difficulty of construction. That is, the life raft of Miller, et al., requires a plurality of straight tubular segments to be formed and joined with a plurality of seams therebetween. Thus, a large number of separate pieces of body fabric must be cut, fitted to one another, and joined by leak-proof seams to construct a life raft according to the conventional teaching. All in all, the life raft of Miller, et al., is believed to be inherently intensive of both labor and materials.

Further, a basic need has been recognized for a new type of life raft. This new specie of life raft is herein referred to as a flotation platform. The principal use envisioned for flotation platforms is aboard aircraft, even though they may also be used aboard other craft. Presently, aircraft which fly over bodies of water and more than 150 miles from shore are required to carry conventional life rafts and survival gear. However, aircraft which fly over water but never more than 150 miles from shore are required only to carry flotation assistance equipment, such as boyant seat cushions and inflatable life vests.

However, experience has shown that aircraft passengers placed into the cold sea by an aircraft wreck with only flotation assistance equipment have a very poor chance of survival because of exposure and hypothermia. Even though rescue equipment and assistance may require only a few minutes to reach the scene of the aircraft wreck or ditching, passenger survival rates may be very low. Thus, there has been recognized a need for a flotation platform which is relatively light in weight and low in deflated package size and bulk. Such a flotation platform may be carried aboard aircraft not designed to carry more than flotation assistance equipment, such a boyant seat cushions. Such a flotation platform need not provide facility for long-term occupancy. That is, water and food need not be provided, and extensive environmental sheltering for those aboard the platform need not be provided Further, it is recognized that an optimized flotation platform will allow able-bodied evacuees to leave the sea and board the platform quickly. Additionally, such a platform should provide purchase for those able-bodied evacuees already aboard the platform to assist other evacuees in the sea, who may be suffering from injury or hypothermia, to board the platform. Still further, such a platform should include bifacial sea ballast structure which will assist in stabilizing the platform to increase occupant comfort and safety.

SUMMARY OF THE INVENTION

In view of the many deficiencies of conventional life rafts, only a few of which have been pointed out above, it is a principal object for this invention to provide a bifacial life raft which is both relatively light in weight and relatively easy to construct while providing as large a number of boarding stations as talent and human ingenuity will provide, and which through aspects of its conformation minimizes the number of seams required in its construction and the risk of leakage presented in use.

Yet another objective of the present invention is to provide a life raft of the above-recited character which is comparatively light in weight and of no greater bulk in its deflated, folded condition than is dictated by the contraints of currently available materials used in its construction.

Still another object for the present invention is to provide a life raft wherein a plurality of boarding stations are inherently defined by the raft without the need for conventional expedients such as inflatable step sections which add superfluous weight and bulk to a life raft.

Yet another object of the present invention is to provide a life raft of the above-cited character which provides sea anchor and stability augmentation structure also of a bifacial nature, and which structure does not interfere with the utility and passenger comfort provided by the raft.

In view of the above, it is a further object for this invention to provide a flotation platform of the above-described character which allows evacuees to quickly leave the sea and board the platform. According to a particularly disclosed preferred embodiment of the invention set forth herein this objective is fully met by the provision of eight boarding stations presented to evacuees regardless of the facial orientation of the platform upon the sea.

Further objects of this invention are to provide a method of constructing and a method of using a life raft of the character described.

To this end, the invention provides a bifacial life raft comprising a stacked pair of flexible, gas distensible and open-centered similar polygons secured to one another and to a panel of fabric sandwiched therebetween, the panel defining a floor for the raft. The open-centered polygons are secured to one another with an apex of each substantially congruent with a side of the other so that a crotch or crevice is defined between each adjacent pair of apexes. Each of the crotches defines a boarding station for the life raft whereat the underlying polygon inherently cooperates with the upper of the pair of polygons to define a boarding step or step-like crawlway by which passengers may board the raft from the sea.

Further, between each adjacent pair of boarding stations, an apex of one of the polygons protrudes outwardly beyond the adjacent side of the other of the pair of polygons. Each such protruding apex provides an area of purchase whereat a passenger already aboard the raft may conveniently assist a person in the sea at one of the adjacent boarding stations to board the raft. A particularly beneficial aspect of this feature is that each crotch, each boarding station, is in fact disposed between a pair of protruding adjacent apexes. Thus, a pair of passengers may work from the pair of apexes to assist a weakened or injured person in the crotch therebetween to board the life raft.

A preferred disclosed embodiment of the invention comprises a pair of stacked open-centered squares sandwiching a panel of fabric therebetween. The open-centered squares are substantially identical and each comprises flexible tubular gas distensible structure which is substantially circular in cross section. The open-centered squares are secured to one another and to the floor panel therebetween with the apexes of each substantially congruent with the side centers of the other. A plurality of straps and handholds are secured to the tubular structure so as to provide equal facility for passengers to leave the sea and board the raft irrespective of which side thereof is upwardly facing.

Additionally, a particularly disclosed preferred embodiment of the invention presents bifacial sea anchor structure comprising a substantially triangular web of fabric slackly spanning each inside corner of each open-centered square. In other words, on each face of the flotation platform are four slack triangles of water-holding fabric which each cooperate with the remainder of the platform to define a pocket for trapping sea water. Because the fabric webs are slack, the four webs on the upward face of the platform may lie loosely in the corners of the platform without interferring with use of the corners of the platform by evacuees.

Further to the above, a method of making a life raft according to the invention and a method of using the inventive life raft are disclosed. Additional objects and advantages of the present invention will be apparent in light of the following detailed description of preferred embodiments of the invention.

DETAILED DESCRIPTION OF THE PREFERRED EMBODIMENTS

Figure 1:
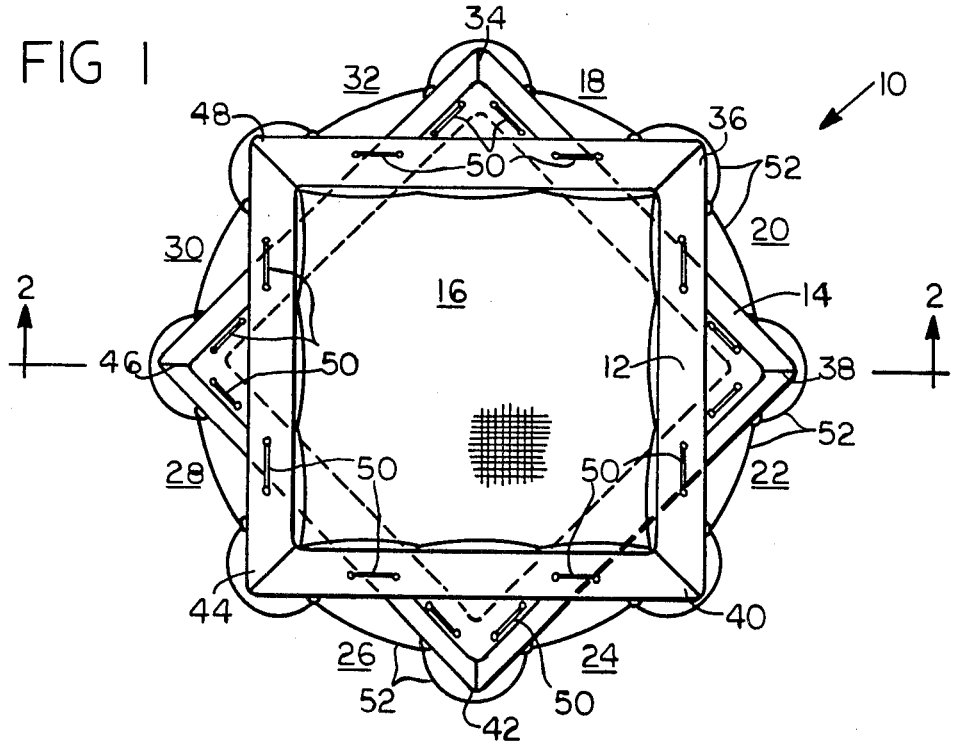
FIG. 1 is a top plan view of a preferred square-on-square embodiment of the invention.

FIG. 1 depicts a particularly preferred embodiment of the invention in its inflated condition as it would appear upon the surface of the sea when viewed from directly overhead. The flotation platform 10 will quickly be seen to appear as an octagonal star having eight points and sixteen sides. However, closer examination of the platform 10 will reveal that it comprises two substantially identical open-centered gas inflatable squares 12 and 14, which are stacked and secured to one another. The squares 12 and 14 are each defined by four substantially straight tubular inflatable sections of flexible air-proof fabric. The tubular sections have a generally circular cross-section. Each of the tubular sections of each square 12 and 14 is in gas communication with its adjacent tubular sections at the mitered corners of the squares 12,14. The squares 12 and 14 are secured to one another so that the apexes of each is substantially congruent with the center of the sides of the other square. Accordingly, viewing FIG. 1 it will be seen that because each square 12,14 has four apexes or corners, the angle of relative rotation between the squares 12,14 is equal to 180° divided by 4, or 45°.

Sandwiched between the squares 12,14, and secured to each, is a web 16 of flexible fabric defining a floor for the platform 10. The web 16 defines at its perimeter an octagonal star shape so as to span fully the center of each square 12,14.

Figure 2:
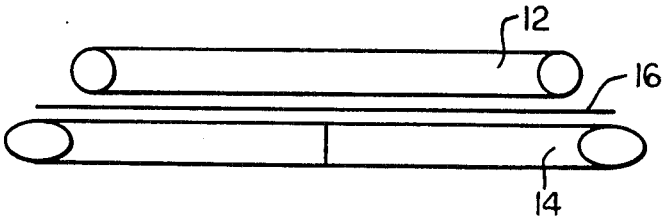
FIG. 2 is a fragmentary exploded cross sectional view taken along line 2—2 of FIG. 1, and with some features omitted for clarity of illustration.

Further inspection of the platform depicted by FIGS. 1 and 2 will reveal that the platform defines eight crotches or boarding stations 18–32. Each of the eight boarding stations 18–32 is usable regardless of which face of platform 10 is upward. The boarding stations are defined between adjacent protruding apexes 34–48 of the squares 12,14. That is, the boarding stations 18–32 are defined at obtuse exterior reentrant angles formed in plan view by the angular juxtaposition of the respective sides of the squares 12,14. Because each square 12,14 has four equal sides, and each is relatively rotated 45° with respect to the other, the reentrant angles at boarding stations 18–32 are each substantially equal to 360° divided by the number of sides (4), plus the angle of relative rotation (45°) or 135° according to the preferred embodiment as disclosed. Each face of the platform 10 further includes a number of similarly disposed relatively short straps 50 (only one set of which is visible) which define handholds for use by evacuees in boarding the platform. Similarly, a single set of relatively longer straps 52 circumscribes the perimeter of the platform 10. The straps 52 may be used both as handholds and stirrups by evacuees boarding the platform.

Having described the structure of platform 10, attention may now be directed to the use of the platform. Consideration of FIG. 1 will immediately make clear how able-bodied evacuees may make use of the eight boarding stations 18–32. That is, an evacuee at a boarding station may use the straps 50 and 52 to haul himself from the sea and partially onto the platform 10. From such a position, an evacuee can complete boarding of the platform by placing one knee or a foot upon the protruding apex of the underlying one of the squares (as illustrated, on square 14) to scramble aboard the platform.

The platform 10 provides particular advantage when injured or otherwise disabled evacuees are to be brought aboard the platform. Viewing FIG. 1 once again, it will be seen that each boarding station 18–32 is bracketed between an adjacent pair of the apexes 34–48. Thus, an able-bodied evacuee aboard the platform 10 may take a position at one of the protruding apexes 34–48 in order to assist disabled evacuees from the sea at an adjacent boarding station 18–32. Further, a pair of able-bodied evacuees may take positions at a pair of adjacent apexes in order to assist disabled evacuees to board the platform 10 at the boarding station therebetween. For example, a pair of able-bodied evacuees at apexes 34 and 36 may together assist a disabled evacuee at boarding station 18 to leave the sea and board the platform.

Figure 3:
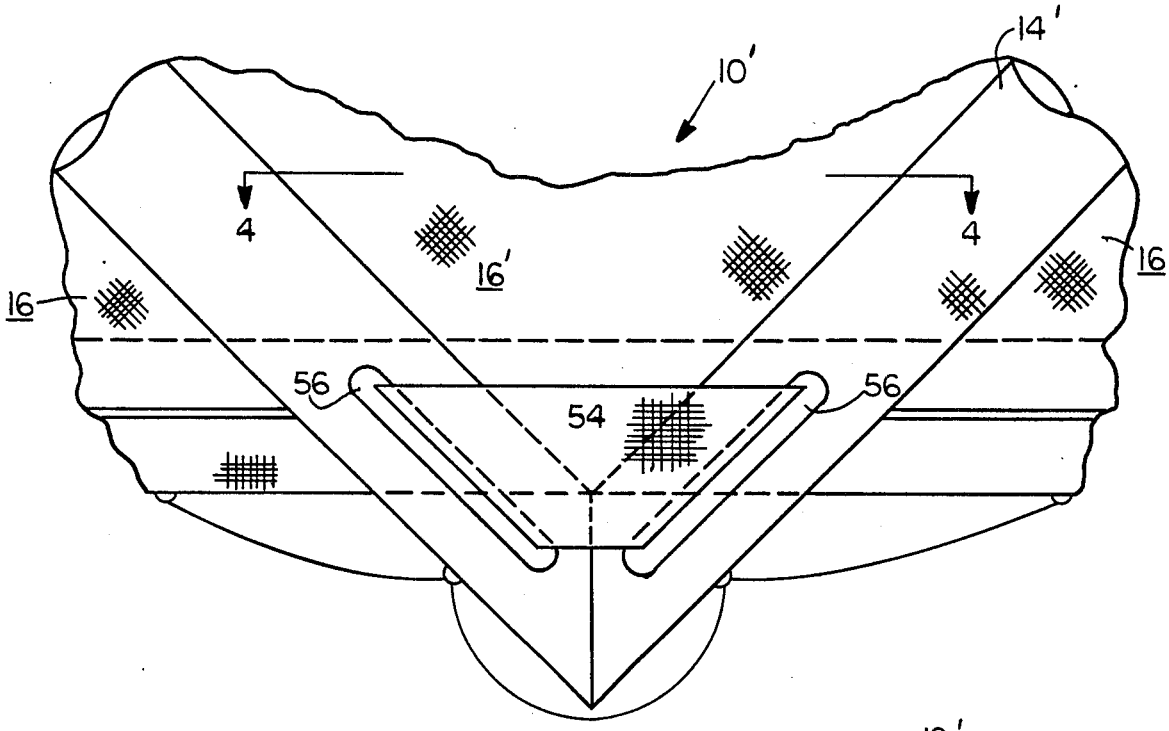
FIG. 3 depicts a fragmentary view of the underside of an alternative embodiment of the invention having sea anchor structure thereof.
Figure 4:
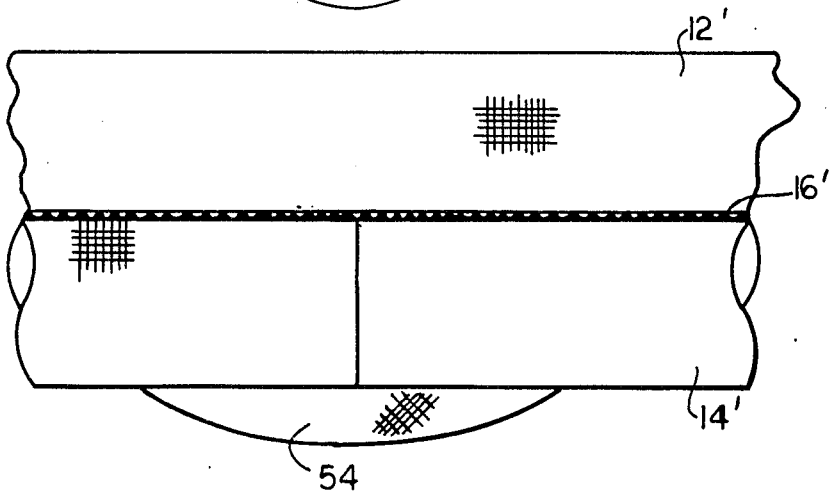
FIG. 4 depicts a fragmentary view taken along line 4—4 of FIG. 3.

FIG. 3 and 4 depict an alternative embodiment of the invention wherein reference numerals used in FIGS. 1 and 2 and having a prime added indicate similar or analogous structure. Flotation platform 10' includes a substantially triangular web of fabric 54 which spans an apex of one of the open centered squares 12,14. By way of example, web 54 spans a corner of square 14'. Web 54 is secured to tubular section 14', as by a seam 56. The web 54 is spaced from the floor fabric 16 and includes sufficient slack that it may bow downwardly as depicted in FIG. 4. According to a preferred embodiment of the invention, a flotation platform as depicted in FIG. 1 may further include a web 54 at each inside corner of each of the squares 12,14. Thus, irrespective of which face of the platform is upward, four of the webs 54 will be on the downward face of the platform to receive sea water therein. As seen in FIG. 4, the webs 54, because of their slack, define pockets or basins within which sea water may be recieved to add ballast weight and stability to the platform 10. Conversely, the webs 54 on the upwardly disposed face of the platform 10', also because of their slack, may lie limply in the corners of the platform. Thus, the webs 54 on the upward face of the platform do not interfere with the use of the platform corners by evacuees.

While the present invention has been depicted, described, and defined by reference to particularly preferred embodiments thereof, no limitation upon the invention is implied by such reference and none is to be inferred. The invention is intended to be limited only by the spirit and scope of the appended claims which provide a definition of the invention.

I claim:

1. Bouyant life raft structure comprising four elongate substantially equal length straight tubular gas-distensible side section members interconnecting at end portions thereof in gas communication to define four apexes each of substantially ninety degrees included angle and cooperatingly defining a first closed planar square member, a second planar square member substantially identical with said first planar square member, regular equilateral flexible web means having a perimeter of sixteen sides including eight reentrant angles alternating circumferentially with eight outward angles for defining a floor of said life raft structure, said first and said second planar square members being stacked plane-on-plane and intersecuring with said web means at said perimeter thereof to sandwich the latter therebetween with diagonals of said first and said second square members defining therebetween an acute angle of about forty-five degrees, the apexes of each said first and said second square member aligning radially with and protruding outwardly of the respective centers of the side section members of the other of said first and said second square member, said side section members of said first and said second square members being thereby disposed angularly in plan view and vertically one above the other to define reentrant exterior angles of substantially 135° included angle to define eight step-like and crotch-lide evacuee boarding stations circumferentially spaced around said life raft structure between adjacent protruding apexes of said first and said second square members, each boarding station being useable irrespective of which one of said first square member and said second square member is upward upon a body of water.

2. Bifacial and reversible inflatable flotation platform structure comprising a first open-centered planar regular polygon including a determined number of substantially equal-length fluid distensible side section tubular members intersecting and intersecuring in gas communication at the ends thereof to define said determined number of corners each of substantially equal included angle;

a second polygon of substantial similarity with said first polygon;

said first polygon and said second polygon being stacked plane-on-plane to define a first face and an opposite second face for said flotation platform and intersecuring in relatively rotated relationship to define an angle of relative rotation therebetween in plan view equal to 180° divided by said determined number, said corners of each of said first polygon and Esaid second polygon substantially aligning with and protruding radially outwardly beyond the centers of respective side section members of the other of said first polygon and said second polygon;

said side section members of each of said first polygon and said second polygon being angularly disposed vertically with respect to said side section members of the other of said first polygon and said second polygon to define obtuse exterior reentrant angles in plan view each substantially equal to 360° divided by said determined number plus said angle of relative rotation, each reentrant angle being disposed between circumferentially adjacent corners of said stacked first polygon and second polygon, thereby to define an evacuee boarding station at each one of said exterior angles which is useable for boarding of said flotation platform irrespective of which of said first face and said second face thereof is upward when said flotation platform is inflated upon a body of water;

a floor web sandwiched between said first polygon and said second polygon and intersecuring to each, said floor web substantially conforming in shape with said flotation platform in plan view.

3. The invention of claim 2 wherein said flotation platform further includes sea anchor means for receiving water from said body of water as ballast for said flotation platform, said sea anchor means comprising a plurality of generally triangular web members, respective ones of said plurality of web members securing along respective side edges thereof to intersecting ones of said side section members to slackly span each of a respective plurality of said corners of said stacked first polygon and second polygone and being spaced from said floor web, a substantially equal number of said web members being disposed on each of said first and said second face of said flotation platform, said web members on the one of said first face and said second face which is upward lying slackly adjacent said floor web thereby to not substantially interfere with occupancy of said respective corners by evacuees, said web members on the downward face of said flotation platform cooperating with respective adjacent side section members to define respective water receiving basins.

4. A bifacial reversible life raft comprising:

a first fluid distensible beam structure having four substantially equal-length elongate tubular inflatable beam members intersecured at the ends thereof to form a generally square planar open-centered structure having four corners each of substantially 90° included angle;

a second fluid distensible beam structure having four substantially equal-length elongate tubular inflatable beam members intersecured at the ends thereof to form a generally square planar open-centered structure having four corners each of substantially 90° included angle, and being substantially similar to said first beam structure;

said first beam structure and said second beam structure being intersecured one upon the other to define a first face and an oppostie second face for said life raft and being relatively angularly disposed at an angle of substantially 45° in plan view such that each corner of each of said first beam structure and said second beam structure radially aligns with and protrudes radially outwardly of the center of a respective tubular beam member of the other of said first beam structure and said second beam structure;

each tubualr beam member of each of said first beam structure and said second beam structure forming an obtuse exterior reentrant angle of substantially 135° in plan view with a respective vertically juxtapositioned beam member of the other of said first beam structure and said second beam structure, said reentrant angles being spaced circumferentially around said life raft between circumferentially adjacent protruding corners of said first beam structure and said second beam structure, and each reentrant angle defining a location of a step-like evacuee boarding station which is useable for evacuee boarding irrespective of the facial orientation of the life raft when inflated upon a body of water;

a floor web interposed between said first beam structure and said second beam structure and securing to both, thereby to provide support for evacuees occupying said open center of one of said first beam structure and said second beam structure.

5. The invention of claim 4 wherein said life raft further includes means at the perimeter thereof for providing purphase for evacuees to board said life raft from said body of water.

6. The invention of claim 4 further including sea ballast structure for receiving and holding a quantity of water from said body of water.

7. The invention of claim 6 wherein said sea ballast structure comprises a generally triangular water-holding fabric piece securing at two respective edges thereof to intersecuring ones of said beam members so that a third edge of said fabric piece spans a corner defined by said beam members and is spaced from said floor web, said fabric piece cooperating with said beam members to define a water-receiving basin open at said third edge for receiving water therein.

* * * * *

UNITED STATES PATENT AND TRADEMARK OFFICE

CERTIFICATE OF CORRECTION

PATENT NO. : 4,614,500

DATED : September 30, 1986

INVENTOR(S) : David D. Miller

It is certified that error appears in the above-identified patent and that said Letters Patent is hereby corrected as shown below:

Column 6, line 35, change "crotch-lide" to --crotch-like-- line 59, change "Esaid" to --said--

Column 7, line 26, change "polygone" to --polygon--

Column 8, line 14, change "tubualr" to --tubular-- line 35, change "purphase" to --purchase--

Signed and Sealed this

Third Day of March, 1987

*Attest:*

DONALD J. QUIGG

*Attesting Officer*

*Commissioner of Patents and Trademarks*